US012527399B2

(12) United States Patent
Pogačar et al.

(10) Patent No.: US 12,527,399 B2
(45) Date of Patent: Jan. 20, 2026

(54) DRAWER GUIDING SYSTEM FOR A HOUSEHOLD APPLIANCE, SUCH AS A STOVE

(71) Applicant: Gorenje, d.o.o., Velenje (SI)

(72) Inventors: Marko Pogačar, Velenje (SI); Tadej Plantev, Ljubno ob Savinji (SI); Mao Jiaojie, Qingdao (CN)

(73) Assignee: Gorenje, d.o.o., Velenje (SI)

( * ) Notice: Subject to any disclaimer, the term of this patent is extended or adjusted under 35 U.S.C. 154(b) by 102 days.

(21) Appl. No.: 18/576,982

(22) PCT Filed: Jul. 12, 2021

(86) PCT No.: PCT/IB2021/056224
§ 371 (c)(1),
(2) Date: Jan. 5, 2024

(87) PCT Pub. No.: WO2023/285853
PCT Pub. Date: Jan. 19, 2023

(65) Prior Publication Data

US 2025/0000255 A1 Jan. 2, 2025

(51) Int. Cl.
*A47B 88/43* (2017.01)
*F24C 15/18* (2006.01)

(52) U.S. Cl.
CPC ..... *A47B 88/43* (2017.01); *F24C 15/18* (2013.01)

(58) Field of Classification Search
CPC ..... A47B 88/43; A47B 88/417; F24C 15/18; F24C 15/168
See application file for complete search history.

(56) References Cited

U.S. PATENT DOCUMENTS

| | | | | | |
|---|---|---|---|---|---|
| 697,471 | A | | 4/1902 | Gercke | |
| 3,211,510 | A | | 10/1965 | Hahn et al. | |
| 4,334,715 | A | * | 6/1982 | Schreiner | A47B 88/483 384/21 |
| 4,735,325 | A | * | 4/1988 | Remmers | A47B 96/068 211/187 |
| 5,366,284 | A | * | 11/1994 | Baker | A47B 88/483 312/334.7 |

(Continued)

FOREIGN PATENT DOCUMENTS

| | | | | | |
|---|---|---|---|---|---|
| AT | 392725 B | * | 5/1991 | | A47B 88/483 |
| CA | 2277940 A1 | * | 6/1999 | | F25D 23/067 |

(Continued)

OTHER PUBLICATIONS

International Search Report issued in PCT/IB2021/056224; mailed Apr. 4, 2022.

*Primary Examiner* — Hanh V Tran
(74) *Attorney, Agent, or Firm* — Studebaker Bracket PLLC

(57) ABSTRACT

A drawer guiding system for a household appliance, such as a stove with an extractable drawer that is arranged in the lower part of the stove below an oven and has two lateral sides, the system consisting of a guide member arranged on the frame of a standalone stove, and a drawer with a drawer guide member arranged on a lateral side of the drawer, wherein the guide member is an elastic guide member comprising a centrally arranged mounting portion, a glide member having convex surfaces and being integrally mounted on the upper portion of the mounting portion in a material-locking manner, a lever member formed as an inverted U with legs which, with each free end, are integrally mounted on the mounting portion at its lower portion in a material-locking manner.

14 Claims, 5 Drawing Sheets

(56) References Cited

U.S. PATENT DOCUMENTS

Figure 1:
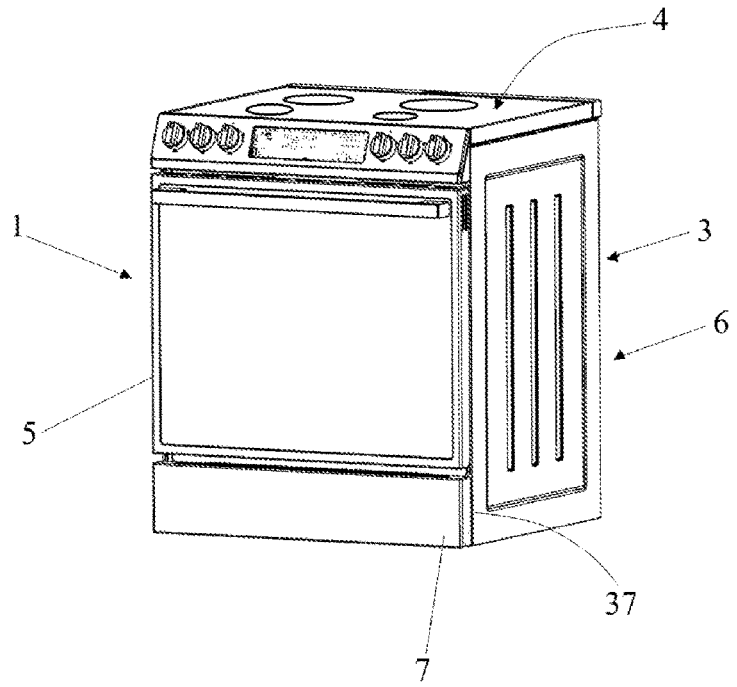

| | | | | | |
|---|---|---|---|---|---|
| 5,904,412 | A * | 5/1999 | Lammens | A47B 88/43 | 312/334.7 |
| 6,945,617 | B2 * | 9/2005 | Wong | A47B 88/44 | 312/334.1 |
| 7,594,707 | B2 * | 9/2009 | Kunkle | A47B 88/497 | 312/331 |
| 9,386,847 | B1 * | 7/2016 | Jeffries | A47B 88/417 | |
| 9,599,349 | B2 * | 3/2017 | Gluf | F24C 15/16 | |
| 2004/0178705 | A1 * | 9/2004 | Wong | A47B 88/44 | 312/334.5 |
| 2016/0334114 | A1 * | 11/2016 | Choi | F24C 15/18 | |
| 2016/0377223 | A1 * | 12/2016 | Heffel | F24C 15/16 | 248/215 |

FOREIGN PATENT DOCUMENTS

| | | | | |
|---|---|---|---|---|
| CA | 2581541 | A1 * | 10/2007 | A47L 15/507 |
| CH | 715007 | A2 * | 11/2019 | A47B 88/57 |
| CN | 104717906 | A * | 6/2015 | F16C 29/10 |
| CN | 104736935 | A * | 6/2015 | A47B 88/487 |
| DE | 102012218536 | A1 * | 4/2014 | F24C 15/168 |
| EP | 0994309 | A2 | 4/2000 | |
| EP | 1358819 | B1 * | 11/2008 | A47B 88/43 |
| EP | 2719955 | A2 * | 4/2014 | F24C 15/168 |
| EP | 2749817 | A2 | 7/2014 | |
| ES | 2583029 | T3 * | 9/2016 | A47B 88/90 |
| JP | H11325711 | A * | 11/1999 | |
| KR | 19980063384 | U * | 11/1998 | |
| KR | 20080112750 | A * | 12/2008 | F25D 25/025 |
| KR | 20210108097 | A * | 9/2021 | A47B 88/483 |

* cited by examiner

DRAWER GUIDING SYSTEM FOR A HOUSEHOLD APPLIANCE, SUCH AS A STOVE

SUBJECT OF INVENTION

The subject of the present invention is a drawer guiding system for a household appliance, such as a stove.

Technical Problem

The technical problem is how to configure a stove drawer guiding system that will be easy not only for the user but above all for the manufacture and economically justifiable, while meeting all the requirements in terms of functionality and safety.

Prior Art

Standalone household appliances, especially stoves, have a hollow space in their lower part in which a drawer is arranged, which is accessible to the user from the outside of the stove. The drawer is intended to accommodate a variety of kitchen utensils, such as various baking trays; it can also serve as a heating drawer and even as a baking drawer if an additional heater is installed.

The basic and simplest versions for guiding the drawer are sliding guides in the form of a folded edge, which are arranged on a part of the stove housing and one pair of sides of the drawer. It is understood that this way of drawer guiding is unreliable; due to the high friction between the two sliding guides, the user finds it difficult to pull out/push in the drawer. The friction between the drawer and the stove housing is greatly reduced by installing roller guides in the form of castors, which are installed in special guide members, which are most often installed both on the housing and the drawer.

Thus, U.S. Pat. No. 9,599,349 (Gluf) describes a roller glide system which is arranged and attached on each side of the drawer, on a part of the stove housing as a stationary member and on the side of the drawer as a movable member. The system includes, at each side of the drawer, a first roller glide disposed and fixed on a part of the stove housing, and a second roller glide disposed and fixed on a lateral side of the drawer. Each roller glide includes a castor rolling on the surface of the flange part of the second, opposite member. The first roller glide thus has a bearing for receiving a castor, which rolls along the inside of the flange flap of the drawer during operation, i.e. opening or closing the drawer. The drawer has a second roller glide mounted on a lateral side in the lower area, closer to the bottom of the drawer, which has a specially formed protruding bearing for receiving two castors. The castors roll on a special additional flange flap which is integrally formed on the stove housing for this purpose. To prevent the drawer from falling out of the second roller glide in particular, it has protrusions formed in the lower part, which cooperate with the opposite castor and prevent the drawer from lifting due to the action of an external force. A disadvantage of such a glide system is its many components, which are demanding to manufacture. This is especially true for castors, which can be a weak element of the system. Each side of the drawer basically has two glides that need to complement each other. The first and second roller glides are configured in such a way that two identical glides arranged on different sides of the drawer are formed in a mirror image. Such a configuration means an additional increase in the number of elements required to operate the drawer. The task of the described system is to guide the drawer when pulled out of the stove and pushed back into the stove, whereby pulling-out and pushing-in of the drawer is uncontrolled. If an additional system for limiting the pulling-out and pushing-in of the drawer is not installed on the drawer and housing, the user can completely extract the drawer from the stove. In the event of the user's negligence, the user may also get injured when the drawer with its contents falls onto his feet.

Solution to the Technical Problem

The technical problem is solved by a drawer guiding system for a household appliance, such as a stove, the main characteristics of which are defined in claim one.

A drawer guiding system for a household appliance, such as a stove with an extractable drawer that is arranged in the lower part of the stove below an oven and has two lateral sides, the system comprising a guide member arranged on the frame of a standalone stove, and a drawer with a drawer guide member arranged on a lateral side of the drawer, the guide member being an elastic guide member comprising a centrally arranged mounting portion; a glide member having convex, surfaces and being integrally mounted on the upper portion of the mounting portion in a material-locking manner; a lever member formed as an inverted U with legs which, with each free end, are integrally mounted on the mounting portion at its lower portion in a material-locking manner. A respective leg of the lever member is formed in a bent manner, so that a guide channel is formed between each upper section of each leg and the glide member in such a way as to receive and guide the outer leg of a guide groove of the drawer.

The drawer guide groove, which is substantially U-shaped, is a drawer guide member arranged on each lateral side of the drawer.

The mounting portion has an elliptical positioning plug arranged on the outer side of the elastic guide portion, and a through hole for receiving a fastening screw.

The legs of the lever member are spaced apart, the distance between them being substantially identical to but not less than the width of a front lateral support, and connected to each other by a connecting element, forming a recess allowing the accommodation of the front lateral support of the stove when the lever member is moved away. The legs of the lever member are formed in all their sections substantially in the form of a U-profile. Between the glide member and the connecting element there is a gap, the height of which is significantly smaller than the depth of the guide groove of the drawer.

The guide groove of the drawer has a one-sided drawer pull-out stop in the rear part, which is formed as a locking protrusion with a ramp, and has a flap in the front portion that limits the pushing-in of the drawer into the stove so that a gap is formed between the stove housing and the front cover of the drawer, said gap corresponding in its dimension to the gap between the stove housing and an oven door, which contributes to the aesthetic appearance of the stove.

The stove drawer and also the drawer guide groove are made of a metal material, preferably sheet steel. The elastic guide member is made of a plastic material having elastic properties and a low coefficient of friction, the material being preferably selected from the group of polyoxymethylenes. Due to the low friction between the stove drawer and the elastic guide member, pulling and/or pushing the drawer requires little force and is user-friendly.

The elastic guide member is formed as an integral member that integrally includes the members for guiding and positioning. The guide members in the form of a glide member with convex surfaces allow a minimal contact with the guide members on the stove drawer, which allows for a smooth extraction of the drawer from the stove and smooth insertion into the stove without halting. The positioning members of the elastic guide member engage the positioning members arranged on the guide groove of the drawer, thus limiting the pulling-out of the drawer from the stove drawer portion as well as the insertion of the drawer back into the stove drawer portion. This eliminates the risk of the user getting injured when pulling out the drawer as well as of the drawer or stove housing getting damaged, noise and damage to either the drawer or the stove housing due to the drawer hitting against the housing is prevented when pushing the drawer back into the drawer portion. A further advantage brought about by the positioning of the drawer in the final closed position is that the visible gap between the appliance housing and the drawer cover is precisely definable. This contributes to the aesthetic appearance of the entire appliance, which creates a positive impression on the user.

Due to the elastically configured lever and its legs, the drawer guiding system according to the invention makes it easy to remove the drawer from the guides and remove it from the stove drawer portion, which is particularly convenient when the user wants to clean the drawer. The elastic guide member allows the user to remove the lever of each elastic guide member by simply pushing the connecting element against the respective side support of the stove, and the drawer is free and completely extractable. The elastic guide member also allows easy insertion of the drawer back into the stove drawer portion. The user only has to lay the drawer with its guide groove on the elastic guide member, more precisely on the glide member, and push the drawer towards the stove.

For the purpose of guiding the drawer between the extraction from and insertion back into the stove, the elastic guide member is arranged on the left and right lateral supports of the stove frame. Due to the symmetrical configuration, it is possible to mount the same elastic guide member on both sides so that the elastic guide member, when mounted on the other side, is rotated by 180° about its vertical axis with respect to the first elastic guide member. This is a great advantage in the technological process because a tool for only one member is required. As a result, installation is also facilitated and improved, as the possibility of incorrect installation of the member is completely eliminated. The installation is further facilitated due to the elliptically shaped mounting plug on the outer side of the elastic guide member. The plug determines the exact position of the elastic guide member and at the same time prevents the member from rotating before being fixed.

Figure 2:
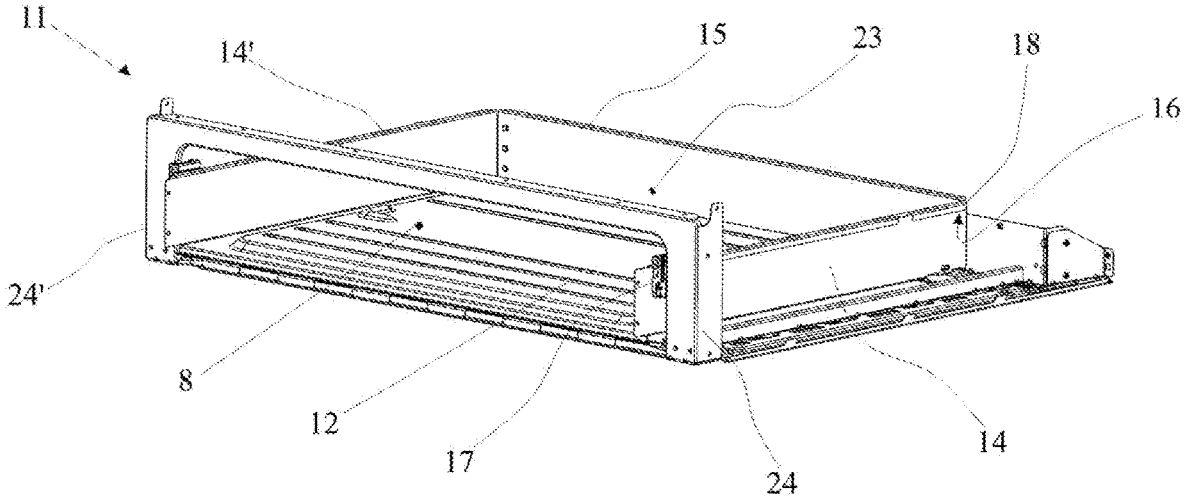
Figure 3:
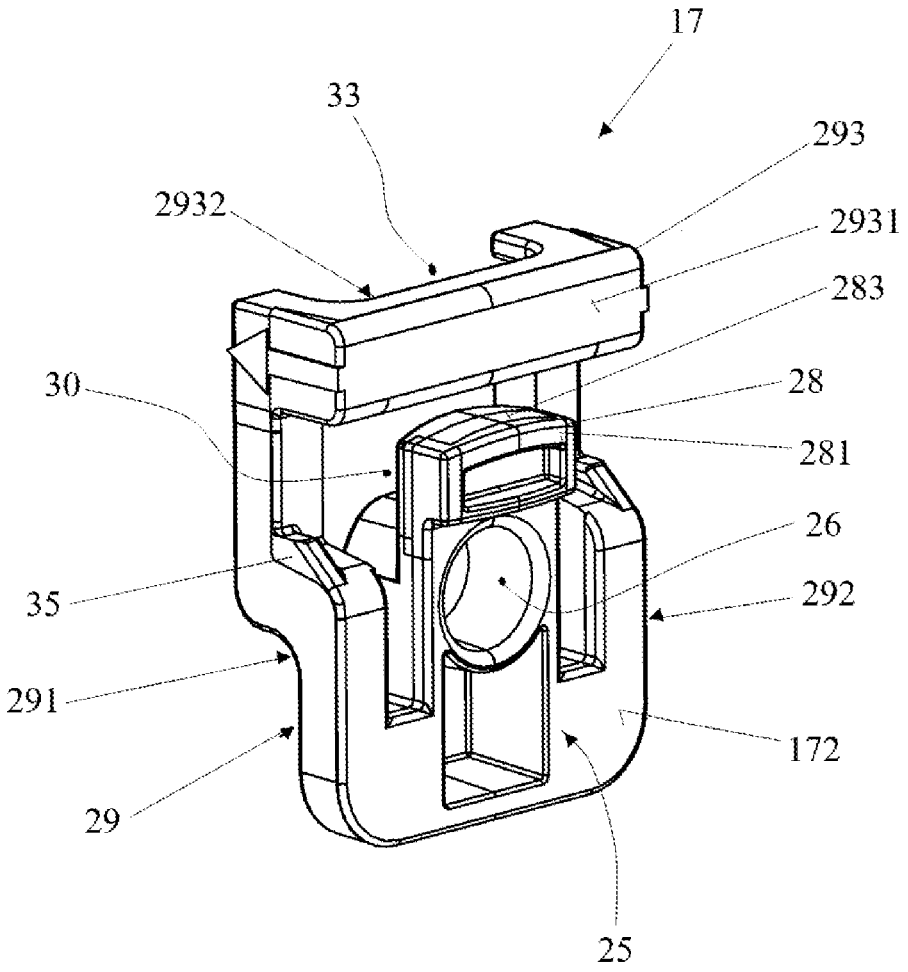
Figure 4:
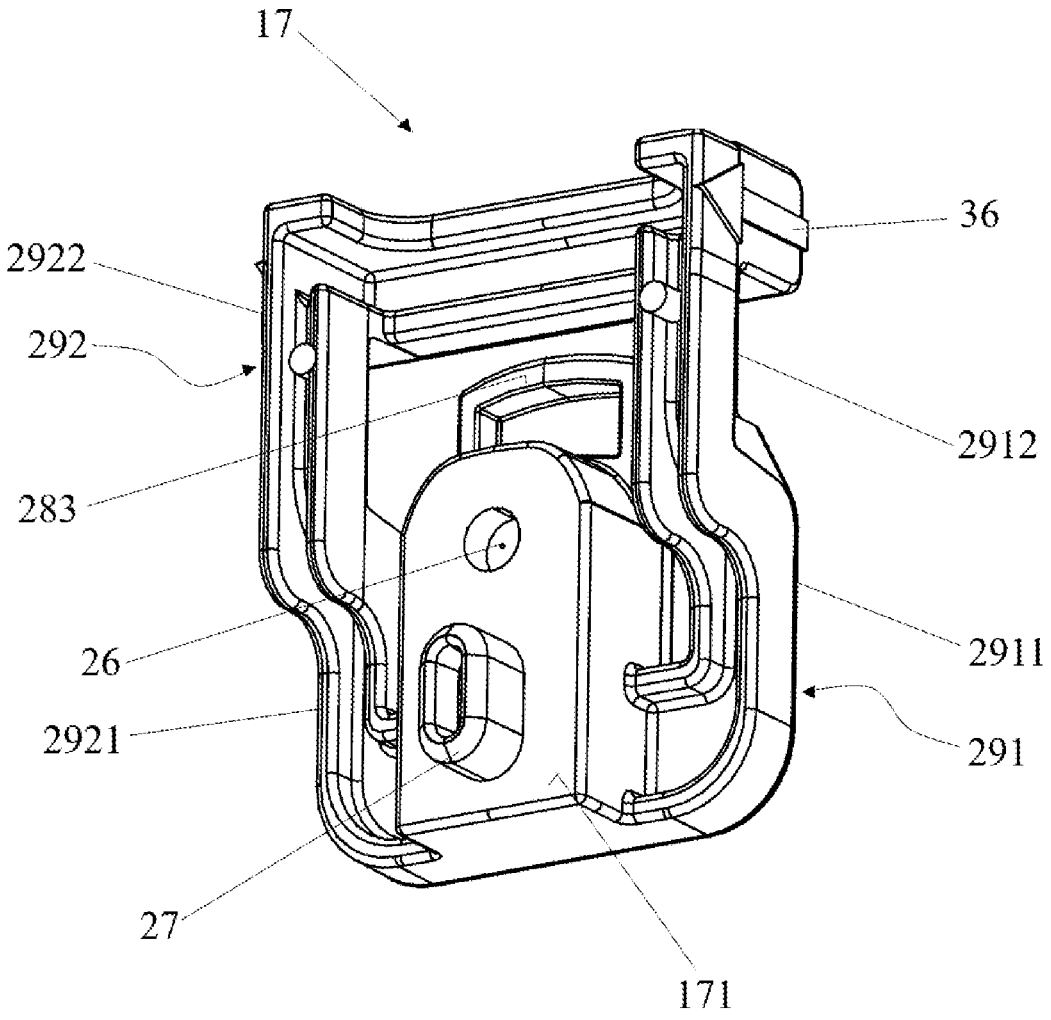
Figure 5:
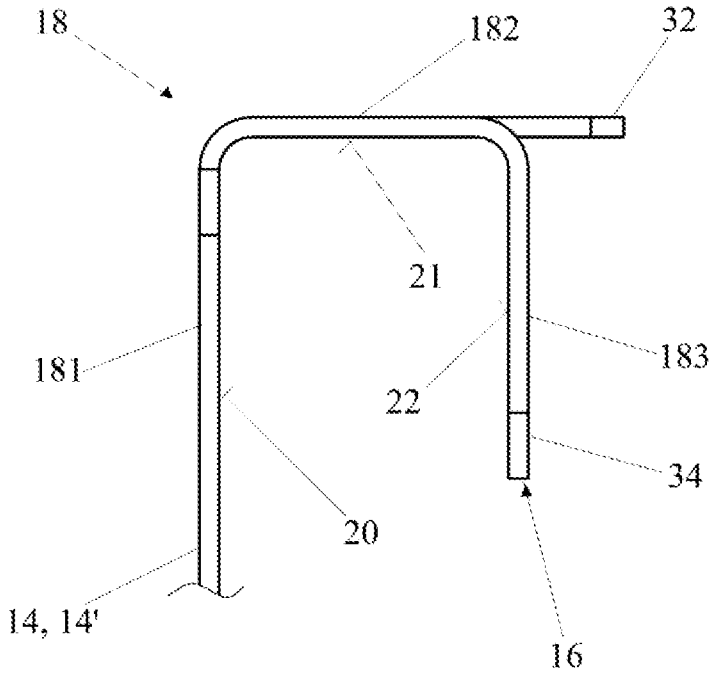
Figure 7:
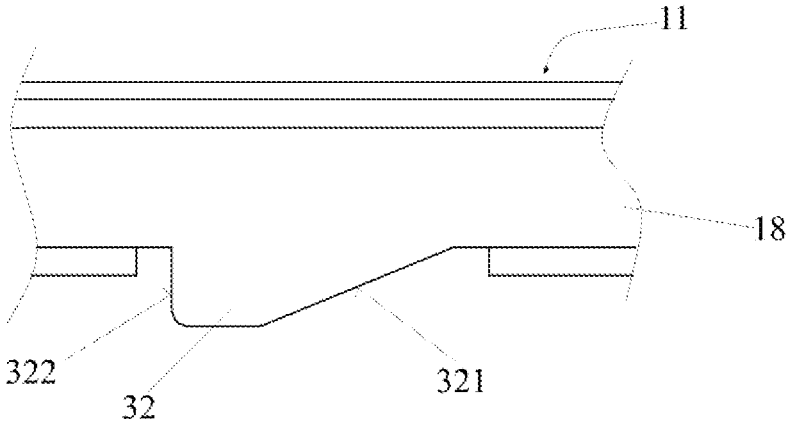
Figure 6:
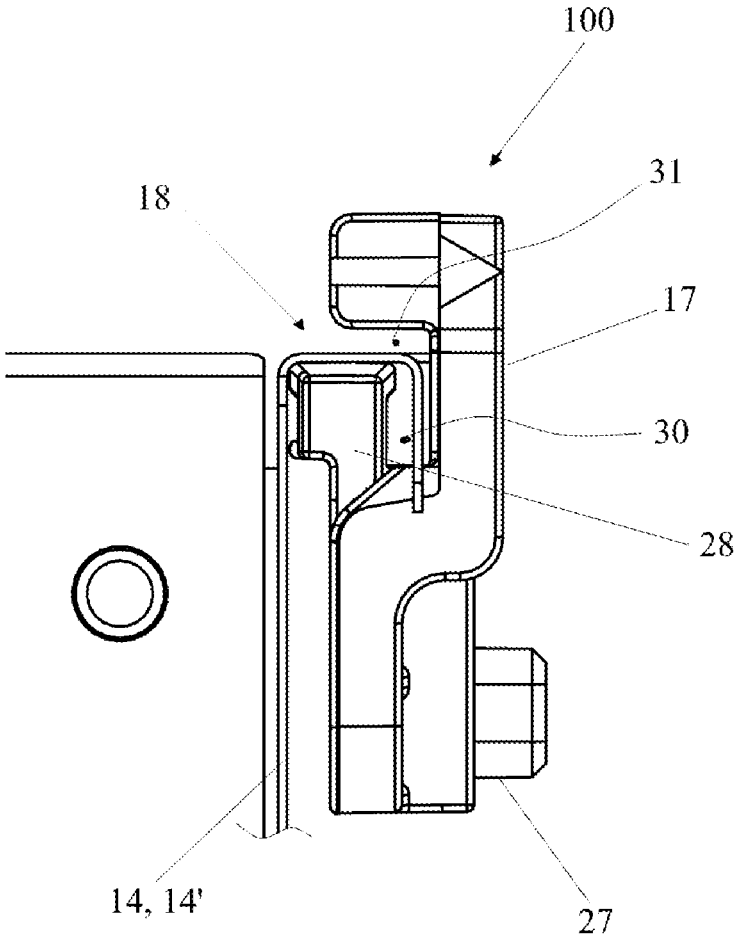
Figure 8:
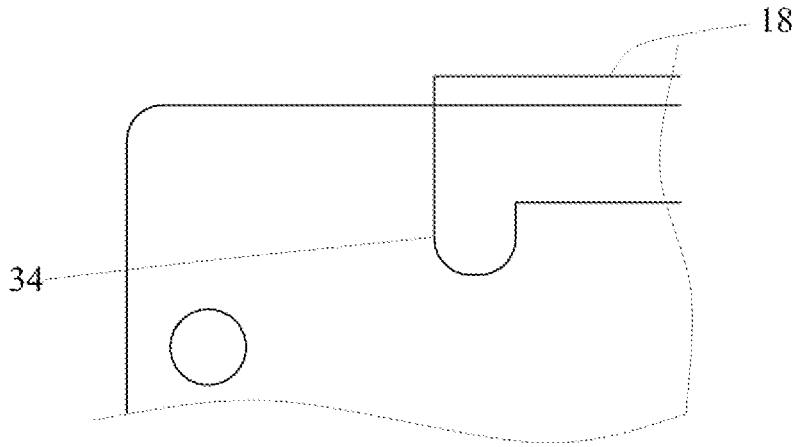

The drawer guiding system for a household appliance, such as a stove, of the invention will be described hereinbelow in more detail by way of an embodiment and drawings representing in FIG. 1 Standalone stove FIG. 2 Drawer inside the stove FIG. 3 Elastic guide member, projection view of the internal side FIG. 4 Elastic guide member, projection view of the external side FIG. 5 Drawer guide groove FIG. 6 Drawer guiding system, cross-section FIG. 7 Drawer guide groove with a lock element FIG. 8 Drawer guide groove with a stop The relative expressions such as front, rear, upper, lower, outside, inside etc. are herein defined from the perspective of the stove user, when the stove is in its functional state.

A household appliance, in the embodiment a standalone stove 1, comprises a housing 2, mounted on a frame 3 of the stove 1, and a hob 4, either electric or gas, wherein inside the housing 2 below the hop 4 there is arranged an oven 5 and in the lower portion closest to the floor, a drawer portion 6. The drawer portion 6 is formed as a cavity and intended for accommodating a drawer 11. The drawer 11 can be a storage drawer for storing various kitchen utensils, such as baking trays, or a heating/baking drawer if an additional heater is installed.

The drawer 11 is essentially a container without a lid, which is dimensionally adapted to the drawer portion defined by the frame 3 or part of the frame 3 of the stove 1. The drawer 11 can be pulled out through a front opening 8 formed by the drawer portion 6 of the frame 3 of the stove 1, the pulling out of the drawer 11 being guided by a drawer guiding system 100 comprising an elastic guide member 17 arranged on the frame 3 of the stove 1 and the drawer guide member 18 in the form of a guide groove.

The drawer 11 has a bottom 12, lateral sides 14, 14' and a back side 15, all of which extend perpendicularly to the bottom 12 of the drawer. Each lateral side 14, 14' of the drawer has a free edge 16 folded outwards so as to form a substantially U-shaped guide groove 18 with an inner leg 181 proximal to an interior 23 of the drawer and with an inner sliding surface 20, a transverse leg 182 and a main sliding surface 21, which is substantially the bottom of the guide groove 18, and an outer leg 183 distant from the interior 23 of the drawer and the outer sliding surface 22, the legs 181, 182, 183 being substantially perpendicular to each other and straight.

An element of the drawer guiding system 100 is also the elastic guide member 17 which is arranged on a respective front lateral support 24, 24' of the stove frame 3 at the height of the guide groove 18 of the drawer 11. The elastic guide member 17 has an outer surface 171, with which it rests on the front lateral support 24, 24' when mounted, and an inner surface 172 which, when mounted, faces the interior 23 of the drawer 11. The front lateral support 24, 24' of the frame 3 can be an integral part of the frame 3 or an additional reinforcing element attached to the frame 3.

The elastic guide member 17 comprises

- a central mounting portion 25 with a through hole 26 formed in such a way as to receive a fastening screw and a positioning plug 27 which is elliptical in shape and arranged on the outer surface 171, i.e. the surface with which the elastic guide element 17 rests on the front lateral support 24, 24';
- a glide member 28 having convex surfaces 281, 282, 283 and being integrally mounted on the upper portion of the mounting portion 25 in a material-locking manner, the glide member 28 extending only over a part of the width of the mounting portion 25;
- a lever member 29 formed as an inverted U with legs 291, 292 which, with each free end, are integrally mounted on the mounting portion 25 at its lower portion in a material-locking manner.

The legs 291, 292 of the lever member 29 are spaced apart, the distance between them being substantially identical to but not less than the width of a front lateral support 24, 24'. The legs 291, 292 are formed in a bent manner so that a lower section 2911, 2921 of each leg 291, 292 is aligned with and parallel to the inner surface 172 of the elastic guide member 17, an upper section 2912, 2922 of each leg 291, 292 is offset parallel to the inner surface 172 of the elastic guide member 17. The upper sections 2912, 2922 of each leg 291, 292 are interconnected by a connecting element 293, the inner surface 2931 of which is substantially aligned with the inner surface 172 of the elastic guide member 17 and the outer surface 2932, in the mounted state, is spaced from the front lateral support 24, 24' so as to form a recess 33 between the legs 291, 292. As each leg 291, 292 is formed in a bent way, a guide channel 30 is formed between the respective upper section 2912, 2922 of the respective leg 291, 292 and the glide member 28, said channel 30 being formed in a way to receive and guide the outer leg 183 of the guide groove 18 of the drawer 11 when the drawer 11 is being pulled out of the drawer portion 6 or pushed into it. The width of the guide channel 30 between the upper section 2912, 2922 of each leg 291, 292 and the glide member 28 is narrow enough to perform the function of guiding the guide groove 18 and the outer leg 183 without undesired wobbling and wide enough to allow easy insertion of the drawer 11 or its guide groove 18 into the guide channel 30.

The legs 291, 292 of the lever member 29 are formed in all their sections substantially in the form of a U-profile. Such configuration provides sufficient elasticity of the lever member 29, which will be explained below, and at the same time sufficient strength required for guiding the drawer. Due to the configuration with the U-profile, the mass of the entire elastic guide member is reduced, thus reducing the required amount of material.

The guide groove 18 of the drawer 11, particularly its legs 181, 182, 183 abut the glide member 28 or its convex surfaces 281, 282, 283 when the drawer 11 is pulled out or pushed in. Due to the convex surfaces, the contact surface between the glide member 28 and the guide groove 18 of the drawer 11 is reduced to a substantially line contact, which significantly reduces the friction between the members. As a result, the required force to pull/push the drawer 11 is minimal.

Between the glide member 28 and the connecting element 293 there is a gap 31, the height of which is significantly smaller than the depth of the guide groove 18. The connecting element 293 prevents the drawer 11 from falling off the glide member 28 even in the event when the user would like to lift the drawer away from the base when pulling it out of the stove.

When pulling out the drawer, the user may get injured if the pull-out of drawer 11 is not limited. For this purpose, a one-sided extraction stop is formed in the rear part of the guide groove 18, which is formed as a locking projection 32 with a ramp 321. When the drawer is extracted to a predetermined extreme position, the locking projection 32 with a locking edge 322 rests on the upper section 2912, 2922 of the leg 291, 292, thus preventing further extraction of the drawer 11.

In the case where a complete extraction of the drawer 11 from the stove is required, for example for cleaning purposes, the user simultaneously acts on the lever member 29 in the area of the connecting element 293 towards the exterior of the stove. The connecting element 293 is shifted towards the front lateral support 24, 24', which is made possible by the recess 33 between the legs 291, 292. To assist the user, in order to facilitate the operation on the connecting element 293, an arrow 36 is indicated, which determines the shift direction of the connecting element 293. When inserting the drawer 11 back into the stove, the drawer 11 with the guide groove 18 is pushed onto the glide member 28 and forward into the interior of the stove. The locking projection 32 now rests on the upper section 2912, 2922 of the leg 291, 292 with the ramp 321 which moves the upper section 2912, 2922 of the leg 291, 292 and the drawer 11 slides forward into the stove, while no external force needs to be applied to move a respective leg 291, 292.

To prevent the drawer from contacting the back wall of the stove when being pushed back into the stove, which might damage the drawer or the stove, a tab 34 is formed on the front portion of the guide groove 18. In the closed position of the drawer 11, the tab 34 rests on a stop 35 arranged on a knee of each leg 291, 292. The tab 34 is positioned on the guide groove 18 so that in the closed state of the drawer 11 a visible gap 37 is formed between the stove housing 2 and the drawer front cover 7 attached to the lateral side 14, 14', said gap 37 being dimensionally identical to the gap between the housing 2 of the stove 1 and the oven door 5.

The elastic guide member 17 has an elliptical positioning plug 27 on the outer surface 171 in the area of the mounting portion 25 by means of which the elastic guide member is arranged and positioned on the front lateral support 24, 24'. The shape of the positioning plug 27 prevents the elastic guide member 17 from rotating during the mounting. The elastic guide member 17 is fixed to the front lateral support 24, 24' by means of a screw extending through the through hole.

The elastic guide member 17 is formed as an integral piece having many functional features. The material from which it is made is a plastic material having suitable mechanical properties, such as sufficient elasticity, low coefficient of friction, the material is preferably selected from the group of polyoxymethylenes.

The elastic guide member 17 is configured symmetrically with respect to its vertical axis. The configuration of the elastic guide members 17 allows the arrangement of the same member on the left and right lateral supports 24, 24' without any amendments or machining. As a result, only one set of tools is required to fabricate this element, which simplifies fabrication and increases the economic impact.

The invention claimed is:

1. A drawer guiding system for a cooking household appliance having an extractable drawer with lateral sides, the extractable drawer being arranged in a lower part of the cooking household appliance, the drawer guiding system comprising a guide member arranged on a frame of the cooking household appliance, and a drawer guide member arranged on a lateral side of the extractable drawer, the guide member being an elastic guide member including a centrally arranged mounting portion, a glide member having convex surfaces and being integrally mounted on an upper portion of the mounting portion in a material-locking manner, a lever member formed as an inverted U with legs which, with each free end, integrally mounted on the mounting portion at its lower portion in a material-locking manner, the drawer guide member being formed as a substantially U-shaped drawer guide groove, a tab formed on a front portion of the U-shaped drawer guide groove, which, in a closed state of the drawer, rests on a stop arranged on a knee of each leg.

2. The drawer guiding system according to claim 1, wherein the elastic guide member is configured symmetrically with respect to its vertical axis.

3. The drawer guiding system according to claim 1, wherein the elastic guide member is arranged on a respective front lateral support of the frame at a height of the drawer guide groove of the drawer.

4. The drawer guiding system according to claim 1, wherein the mounting portion has an elliptical positioning plug arranged on the outer side of the elastic guide portion.

5. The drawer guiding system according to claim 4, wherein the mounting portion is provided with a through hole for receiving a fastening screw.

6. The drawer guiding system according to claim 1, wherein each leg of the lever member is formed in a bent way, such that a guide channel is formed between a respective upper section of a respective leg and the glide member, said guide channel is formed in a way to receive and guide an outer leg of the guide groove of the drawer guide member.

7. The drawer guiding system according to claim 6, wherein the legs of the lever member are spaced apart, a distance between them is substantially identical to but not less than a width of a front lateral support of the frame of the cooking household appliance.

8. The drawer guiding system according to claim 6, wherein the legs of the lever member are connected with each other by a connecting element, whereby a recess is formed that allows the accommodation of the front lateral support of the stove cooking household appliance when the lever member is shifted.

9. The drawer guiding system according to claim 6, wherein the legs of the lever member are formed in all their sections substantially in the form of a U-profile.

10. The drawer guiding system according to claim 8, wherein between the glide member and the connecting element there is a gap, the height of which is significantly smaller than a depth of the guide groove.

11. The drawer guiding system according to claim 1, wherein a one-sided extraction stop is formed in a rear part of the U-shaped drawer guide groove, which is formed as a locking projection with a ramp and a locking edge.

12. The drawer guiding system according to claim 1, wherein the elastic guide member is made from a plastic material having elastic properties and a low coefficient of friction.

13. The drawer guiding system according to claim 12, wherein the plastic material is polyoxymethylenes.

14. A cooking household appliance comprising the drawer guiding system according to claim 1.

* * * * *